US011008127B2

(12) United States Patent
McBride, II et al.

(10) Patent No.: US 11,008,127 B2
(45) Date of Patent: May 18, 2021

(54) FLOATING PLATEN SYSTEM

(71) Applicant: Zing-Pac, Inc., Twinsburg, OH (US)

(72) Inventors: Daniel R. McBride, II, Hudson, OH (US); Glenn J. Burkholder, Burton, OH (US)

(73) Assignee: Zing-Pac, Inc., Twinsburg, OH (US)

( * ) Notice: Subject to any disclaimer, the term of this patent is extended or adjusted under 35 U.S.C. 154(b) by 792 days.

(21) Appl. No.: 15/338,636

(22) Filed: Oct. 31, 2016

(65) Prior Publication Data

US 2018/0118392 A1 May 3, 2018

(51) Int. Cl.
*B65B 43/26* (2006.01)
*B65B 9/14* (2006.01)
*B65B 9/13* (2006.01)

(52) U.S. Cl.
CPC ..... *B65B 43/267* (2013.01); *B65B 9/13* (2013.01); *B65B 9/14* (2013.01)

(58) Field of Classification Search
CPC ..... B65B 43/267; B65B 9/13; B65B 9/14
USPC ..... 493/186
See application file for complete search history.

(56) References Cited

U.S. PATENT DOCUMENTS 3,481,102 A * 12/1969 Dolman ..... B65B 9/13 53/459
3,536,005 A 10/1970 Derrickson ..... 101/129
3,594,978 A * 7/1971 Spitznagel ..... B65B 9/14 53/373.4
3,650,207 A 3/1972 Black ..... 101/115
3,774,367 A 11/1973 Lerner ..... 53/67
3,815,318 A 6/1974 Lerner ..... 53/29
3,878,776 A 4/1975 Schneider ..... 101/41
3,882,656 A 5/1975 Lerner ..... 53/29
3,912,145 A 10/1975 Meihofer ..... 226/44
3,945,317 A 3/1976 Brasa ..... 101/124
3,973,489 A 8/1976 Black ..... 101/115
3,973,492 A 8/1976 Black et al. ..... 101/126
3,974,628 A * 8/1976 Konstantin ..... B29C 63/423 53/291
4,307,661 A 12/1981 Wilkins et al. ..... 101/93.01
4,307,662 A 12/1981 Mitter ..... 101/123
4,346,546 A 8/1982 Tasker ..... 53/412
4,365,551 A 12/1982 Horton ..... 101/124
4,586,318 A 5/1986 Litt et al. ..... 53/459
4,730,437 A * 3/1988 Benno ..... B65B 53/00 53/399

(Continued)

FOREIGN PATENT DOCUMENTS

FR 2.079.851 A5 11/1971 ..... B65B 9/13
FR 2.425.983 A1 12/1979 ..... B65B 9/13

OTHER PUBLICATIONS

Sharp Packaging, Inc., *The Sharp Programmable Imprinter Operation Instructions*, (No Date).

(Continued)

*Primary Examiner* — Sameh Tawfik
(74) *Attorney, Agent, or Firm* — Kusner & Jaffe

(57) ABSTRACT

A floating platen system for use in connection with a packaging system that processes tube stock continuous film media to form bags that are filled with product. The floating platen system includes a floating platen that is maintained in a substantially stationary position by use of magnetic forces acting on the floating platen.

20 Claims, 8 Drawing Sheets

(56) References Cited

U.S. PATENT DOCUMENTS 4,765,121 A * 8/1988 Konstantin ..... B65B 9/13 53/442
4,782,751 A 11/1988 Colapinto ..... 101/126
4,819,556 A 4/1989 Abe et al. ..... 101/93.04
5,050,497 A 9/1991 Klemm ..... 101/124
5,092,239 A 3/1992 Bubley ..... 101/115
5,099,736 A 3/1992 Evers ..... 83/861
5,142,980 A 9/1992 Böttger et al. ..... 101/233
5,159,219 A * 10/1992 Chu ..... F16C 32/0438 310/90.5
5,289,770 A 3/1994 Hem ..... 101/226
5,319,275 A * 6/1994 Tozoni ..... B60L 13/04 104/281
5,345,863 A 9/1994 Kurata et al. ..... 101/126
5,729,066 A * 3/1998 Soong ..... F16C 32/0451 310/51
5,923,109 A * 7/1999 Higuchi ..... F16C 32/0438 310/90.5
5,956,929 A * 9/1999 Yisha ..... B65B 9/13 53/385.1
6,755,774 B1 * 6/2004 Nosaka ..... B31B 50/00 493/186
6,890,290 B2 * 5/2005 Pansier ..... B65B 1/18 493/189
6,996,954 B1 * 2/2006 Farley ..... B65B 9/13 493/273
7,963,228 B2 * 6/2011 Studer ..... B60L 13/06 104/282
8,146,334 B2 * 4/2012 Fresnel ..... B65B 9/14 53/389.2
9,142,475 B2 * 9/2015 Skinner ..... H01L 23/32
9,884,696 B2 * 2/2018 Sawamura ..... B65C 3/065
2016/0101633 A1 * 4/2016 De Roeck ..... B65C 3/065
2018/0118390 A1 * 5/2018 Mulder ..... B65B 31/04

OTHER PUBLICATIONS

Sharp Packaging Systems, Inc., *The Sharp One Packaging System User Guide*, 1992.

Automated Packaging Systems, *The Total Systems Approach to Packaging Productivity*, 1996.

* cited by examiner

FLOATING PLATEN SYSTEM

FIELD OF THE INVENTION

The present invention relates generally to a floating platen system, and more particularly to a floating platen system for use in connection with a packaging system that forms bags from a tube stock continuous film media.

BACKGROUND OF THE INVENTION

Some existing packaging systems are adapted for packaging products using a tube stock continuous film media, rather than a bag on a roll. For example, U.S. Pat. No. 5,956,929 to Yisha et al. (issued Sep. 28, 1999) describes such a packaging system, said patent fully incorporated herein by reference. In packaging systems using tube stock continuous film media a floating platen (also referred to as a "puck") may be inserted into a tube formed by upper and lower layers of the media, in order to isolate the upper layer from the lower layer during a cutting operation. The cutting operation forms an opening in the media that is used to fill a package or bag with product. The platen is maintained generally stationary relative to the media, in alignment with a cutting blade, as the media advances through the processing path of the packaging system. Accordingly, the upper and lower layers of media respectively flow over and under the platen, as the media advances. As shown in FIG. 1 of U.S. Pat. No. 5,956,929, the platen is maintained generally stationary to the media by having a protruding portion that is trapped by a locating roller.

Some drawbacks have been observed with respect to the existing floating platen system disclosed in U.S. Pat. No. 5,956,929. In this regard, the floating platen system has "pinch points" that can impede movement of the media through the processing path, thereby resulting in misalignment of the media. For example, media 22 is pinched between the surface of tail portion 34 of floating platen 30 and the surface of locating roller 50 (see FIG. 1 of U.S. Pat. No. 5,956,929). A pinch point can result in additional strain being placed on the drive motor and rollers used to advance the media. Furthermore, the pinch point can make it particularly difficult to advance certain types of media made of materials having higher friction surfaces.

The present invention addresses these and other drawbacks of the prior art to provide an improved floating platen system that eliminates pinch points.

SUMMARY OF THE INVENTION

In accordance with the present invention, there is provided a floating platen system for a packaging system that forms bags from a tube stock continuous film media, said floating platen system includes: (i) a platen having a first magnet; and (ii) a guide assembly having upper and lower guide members that are spaced apart to form a slot therebetween for receiving the platen, each of said upper and lower guide members having at least one magnet, wherein magnetic forces between the magnets of the guide assembly and the first magnet of the platen maintain the platen in a substantially stationary position within the slot.

In accordance with another aspect of the present invention, there is provided a floating platen for a packaging system that forms bags from a tube stock continuous film media, the floating platen comprising: (i) a front body portion; (ii) a rear body portion having a groove extending generally perpendicular to a longitudinal axis of the platen, said groove dimensioned to receive a cutting edge of a blade for cutting a layer of the media; (iii) a main body portion located between the front and rear body portions; and (iv) a magnet for maintaining the floating platen in a substantially stationary position in alignment with the blade.

An advantage of the present invention is the provision of a floating platen system that is adapted for use with media made of a wide variety of materials.

Another advantage of the present invention is the provision of a floating platen system that uses magnetic forces to maintain the floating platen in a substantially stationary position relative to the media.

Another advantage of the present invention is the provision of a floating platen system that is readily adapted for use with existing packaging systems for producing and filling bags using a tube stock continuous film media.

A still further advantage of the present invention is the provision of a floating platen system that is easily adapted for use with tube stock continuous film media having various dimensions.

These and other advantages will become apparent from the following description of illustrated embodiments taken together with the accompanying drawings and the appended claims

BRIEF DESCRIPTION OF THE DRAWINGS

The invention may take physical form in certain parts and arrangement of parts, embodiments of which will be described in detail in the specification and illustrated in the accompanying drawings which form a part hereof, and wherein.

DETAILED DESCRIPTION OF THE INVENTION

Figure 1:
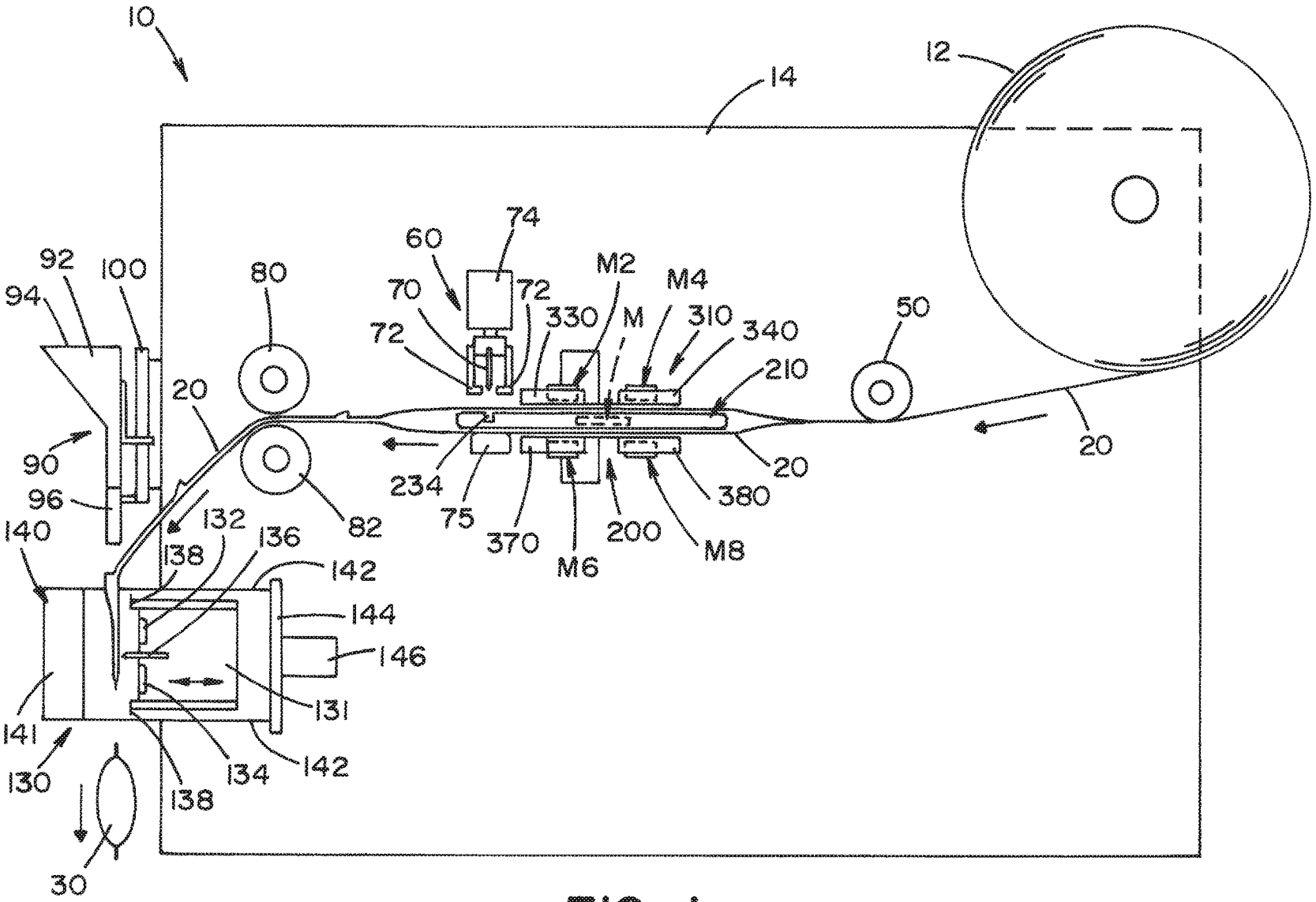
FIG. 1 is a schematic side view of a packaging system that includes a floating platen system according to an embodiment of the present invention.

Referring now to the drawings wherein the showings are for the purposes of illustrating embodiments of the invention only and not for the purposes of limiting same, FIG. 1 shows a schematic side view of a packaging system 10 that includes a floating platen system 200 according to an embodiment of the present invention. The basic components of packaging system 10 will now be generally described. It should be appreciated that many of the components of packaging system 10 are described in detail in U.S. Patent No. 5,956,929, which is fully incorporated herein by reference.

Packaging system 10 is generally comprised of a supply roll 12 of continuous film media 20 (e.g., a metalized polymer, etc.); a floating platen system 200 comprised of a platen 210 and a guide assembly 310; a slit forming unit 60 for forming an opening for bag filling; a filling unit 90 for filling a bag with articles (e.g., food product); and a sealing/cutting unit 130 for sealing and cutting bags. A housing 14 houses platen system 200, forming unit 60, and sealing/cutting unit 130.

Supply roll 12 provides a supply of continuous film media 20 that is comprised of two plies of sheet media (i.e., an upper layer and a lower layer). The upper and lower layers are fused together at the peripheral edges thereof (i.e., at the two side edges) to form a hollow tube. Media 20 may also take the form of a uniform tubular sheet media having no seals, or one or more seals at the peripheral edges thereof. Top and bottom seals, which are needed to complete a fully formed bag, are provided by sealing/cutting unit 130, which is described in detail below.

Before media 20 is fed into housing 14 of packaging system 10, platen 210 of floating platen system 200 is inserted into the tube formed by media 20 in order to isolate the upper layer from the lower layer during a cutting operation. Accordingly, platen 210 is inserted between the upper and lower layers of media 20. As will be explained in detail below, magnets (located in platen 210 and guide assembly 310) are used to maintain platen 210 in a substantially stationary position relative to media 20. Platen 210 and guide assembly 310 are described in detail below.

A roller 50 is a free roller for guiding media 20 between supply roll 12 and floating platen system 200, as it advances through a processing path of packaging system 10.

Slit forming unit 60 forms a slit (i.e., opening) in the upper layer of media 20 to provide a top opening of a bag. Slit forming unit 60 is generally comprised of a blade 70 (e.g., a serrated or straight blade); a pair of spring-loaded L-shaped pressure feet 72; and a pneumatic actuator 74 for moving blade 70 between retracted and extended positions. In one embodiment, pneumatic actuator 74 is comprised of a conventional air cylinder/piston arrangement. When blade 70 is moved to the extended position it contacts the upper layer of media 20 to form a slit in the upper layer of the media, thereby forming the top opening of a bag. Pressure feet 72 hold media 20 in tension against platen 210, as blade 70 cuts the upper layer of media 20. A support surface 75 provides support for platen 210.

A drive roller 80 is driven by a stepper motor (not shown), and advances media 20 through the processing path. A guide roller 82 is a free roller which operates in conjunction with drive roller 80 to advance media 20. Accordingly, drive roller 80 applies a tension to the upper layer of media 20, while guide roller 82 applies an equivalent tension to the lower layer of media 20.

Filling unit 90 functions to both open a bag and fill the bag with articles. Filling unit 90 is generally comprised of a fixed funnel portion 92, a telescoping funnel portion 96, an air cylinder/piston 100, and an air tube (not shown). Fixed funnel portion 92 includes a top end 94 for receiving product to be placed into the bag. Telescoping funnel portion 96 includes an outlet, and is movable relative to fixed funnel portion 92. As telescoping funnel portion 96 is moved downward, it moves into the opening of the bag formed by slit forming unit 60. Product exits filling unit 90 through the outlet of telescoping funnel portion 96. Mounting brackets are provided to mount air cylinder/piston 100 to fixed funnel portion 92 and to attach the air cylinder/piston 100 to telescoping funnel portion 96. The air tube (not shown) extends along the inside of funnel portions 92 and 96. However, it should be noted that the air tube remains fixed relative to funnel portion 92. The air tube includes a tube fitting and a nozzle. The tube fitting is provided at the top end of the air tube for connection to a blower. The nozzle is provided at the bottom end of the air tube. The nozzle guides air (or other gas) into the bag. It should be appreciated that filling unit 90 may be attached to housing 14 or to an infeed or product dispensing device (not shown). In some configurations of packaging system 10, funnel portions 92 and 96 may be omitted.

Sealing/cutting unit 130 is generally comprised of a cutting block assembly 131 and a pressure bar assembly 140. Cutting block assembly 131 is similar in structure and operation to slit forming unit 60. In this regard, cutting block assembly 131 includes spring-loaded L-shaped pressure feet 138 and a serrated blade 136. Serrated blade 136 is provided to cut through the upper and lower layers of media 20 to separate a completely formed (and sealed) bag 30. L-shaped pressure feet 138 hold media 20 in tension against a pressure bar 141 of pressure bar assembly 140, which is described below. This tension aids the cutting of media 20 and improves the quality of seals formed therein. To form seals, cutting block assembly 131 also includes an upper heater bar 132 and a lower heater bar 134. Heater bars 132, 134 may take the form of cylindrical cartridge heaters, which are mounted in cutting block assembly 131. Upper heater bar 132 fuses the upper and lower layers of media 20 to form the bottom seal of a bag, while lower heater bar fuses the upper and lower layers of media 20 to form the top seal of a bag. A detailed description of the operation of packaging system 10 is provided below.

Pressure bar assembly 140 is generally comprised of pressure bar 141, a pair of arms 142, a bar 144, and a pneumatic actuator 146. Pressure bar 141 applies pressure to media 20 such that it is simultaneously pressed against blade 136 and upper and lower heat bars 132, 134. As a result, two seals and a cut are made simultaneously. Arms 142 attach pressure bar 141 to bar 144. Bar 144 is moved inward and outward by pneumatic actuator 146. Pneumatic actuator 146 may be comprised of a conventional air cylinder/piston arrangement.

Figure 2:
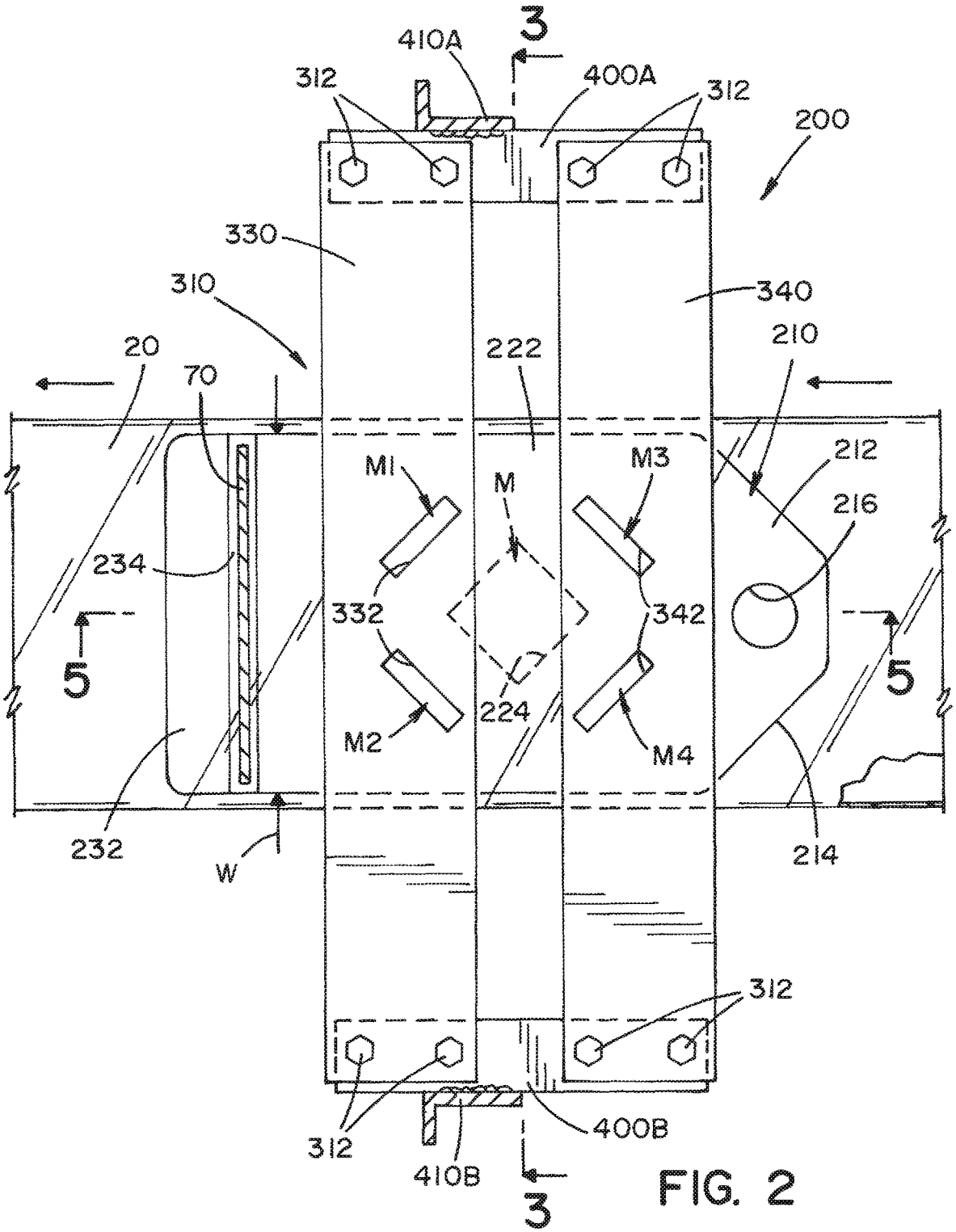
FIG. 2 is a top view of the floating platen system.
Figure 3:
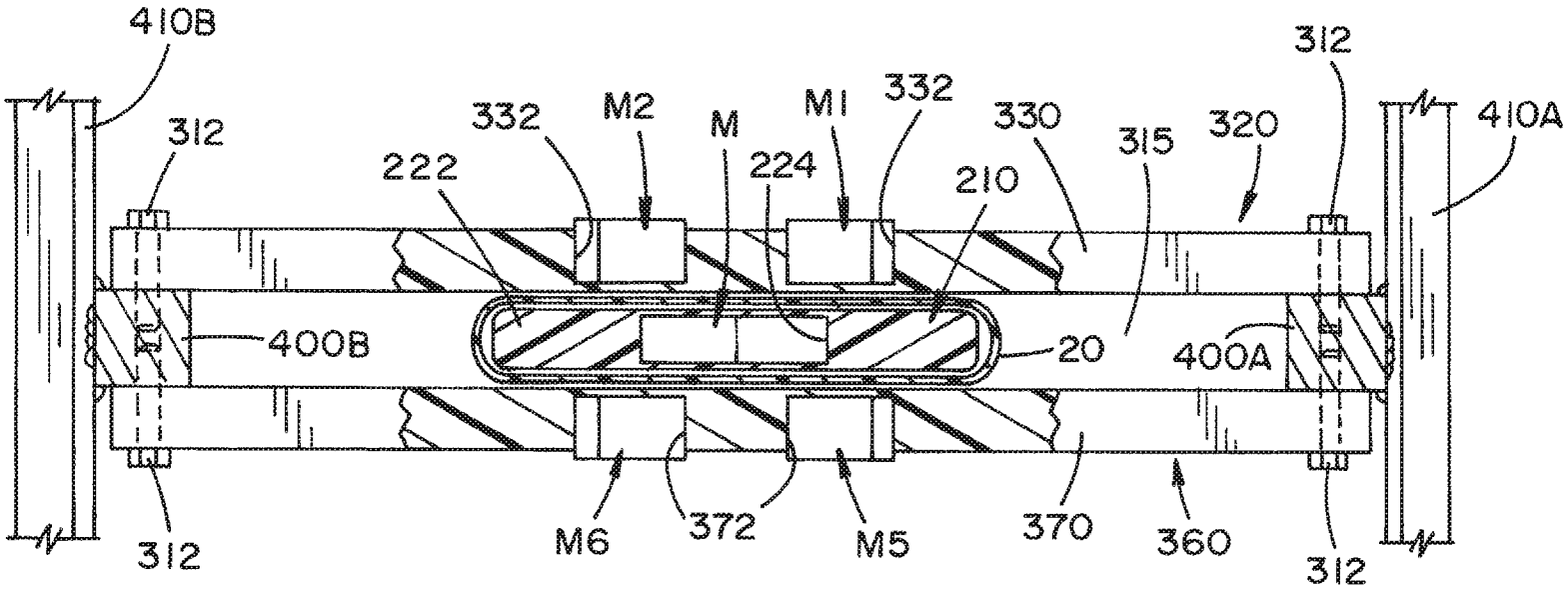
FIG. 3 is a partially broken cross-sectional view of the floating platen system, taken along lines 3-3 of FIG. 2.
Figure 4:
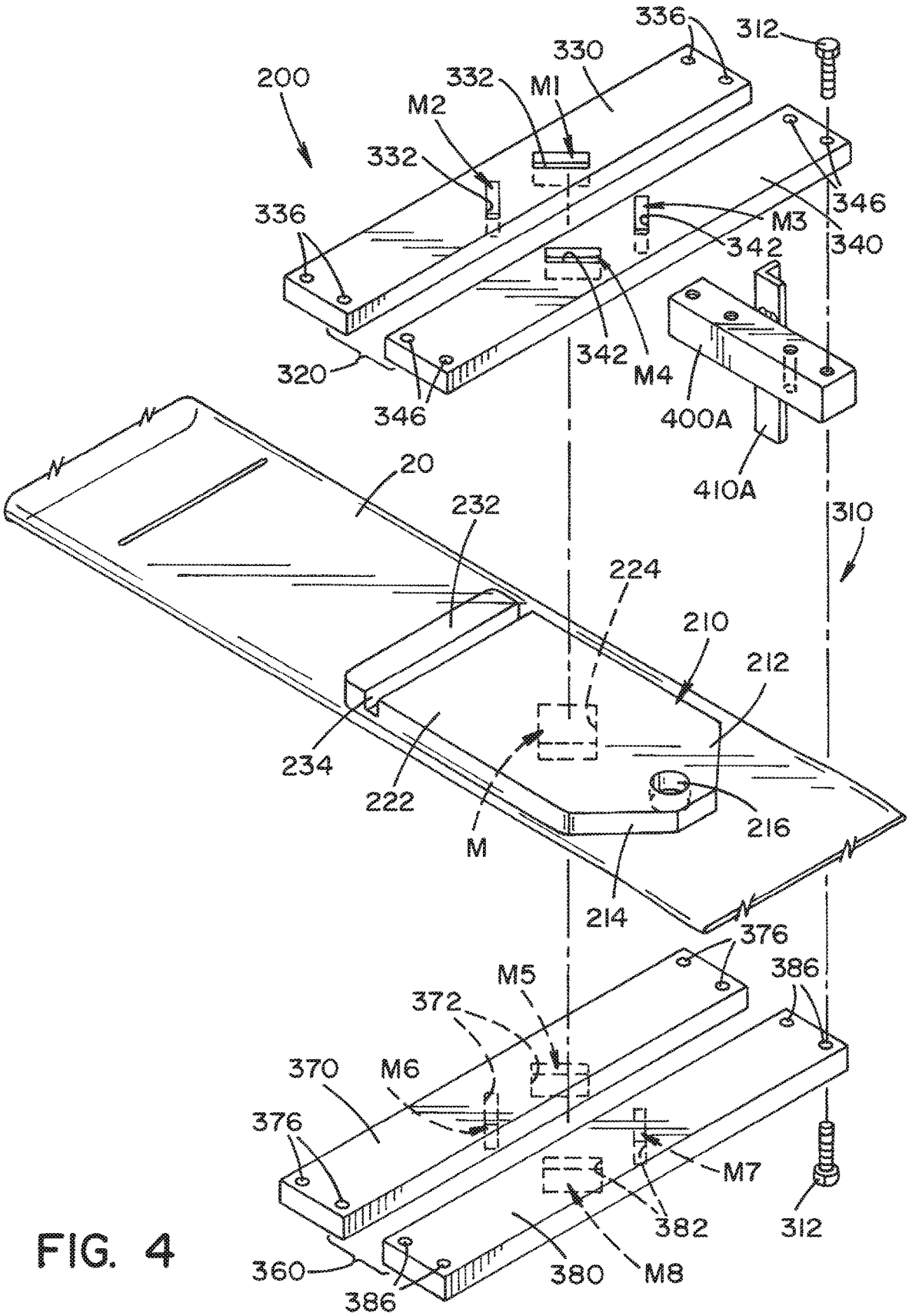
FIG. 4 is an exploded view of the floating platen system.

With reference to FIGS. 2-4, floating platen system 200 according to an embodiment of the present invention will be described in detail. Floating platen system 200 is generally comprised of a floating platen 210 and a guide assembly 310. As indicated above, media 20 is a comprised of upper and lower layers. Platen 210 is dimensioned to be received within a channel formed by the upper and lower layers of media 20. Accordingly, platen 210 has a width W that is dependent upon the width of media 20. In the figures, platen 210 is shown located within the channel.

As best seen in FIG. 4, platen 210 takes the form of a generally planar rectangular body comprised of a front body portion 212, a main body portion 222, and a rear body portion 232. In the illustrated embodiment, front body portion 212 has a tapered front face 214 and a recess or opening 216. Tapered front face 214 facilitates insertion of platen 210 into the channel formed by the upper and lower layers of media 20. In this regard, platen 210 is located within the channel of media 20 by inserting front face 214 of platen 210 into the open end of the tube formed by media 20. Opening 216 of front body portion 212 provides a convenient gripping surface for handling platen 210. Main body portion 222 has an inner recess 224 dimensioned to house a platen magnet M. Rear body portion 232 has an elongated groove 234 that extends generally perpendicular to the longitudinal axis of platen 210. Groove 234 is dimensioned to receive a cutting edge of blade 70 of slit forming unit 60.

Figure 7:
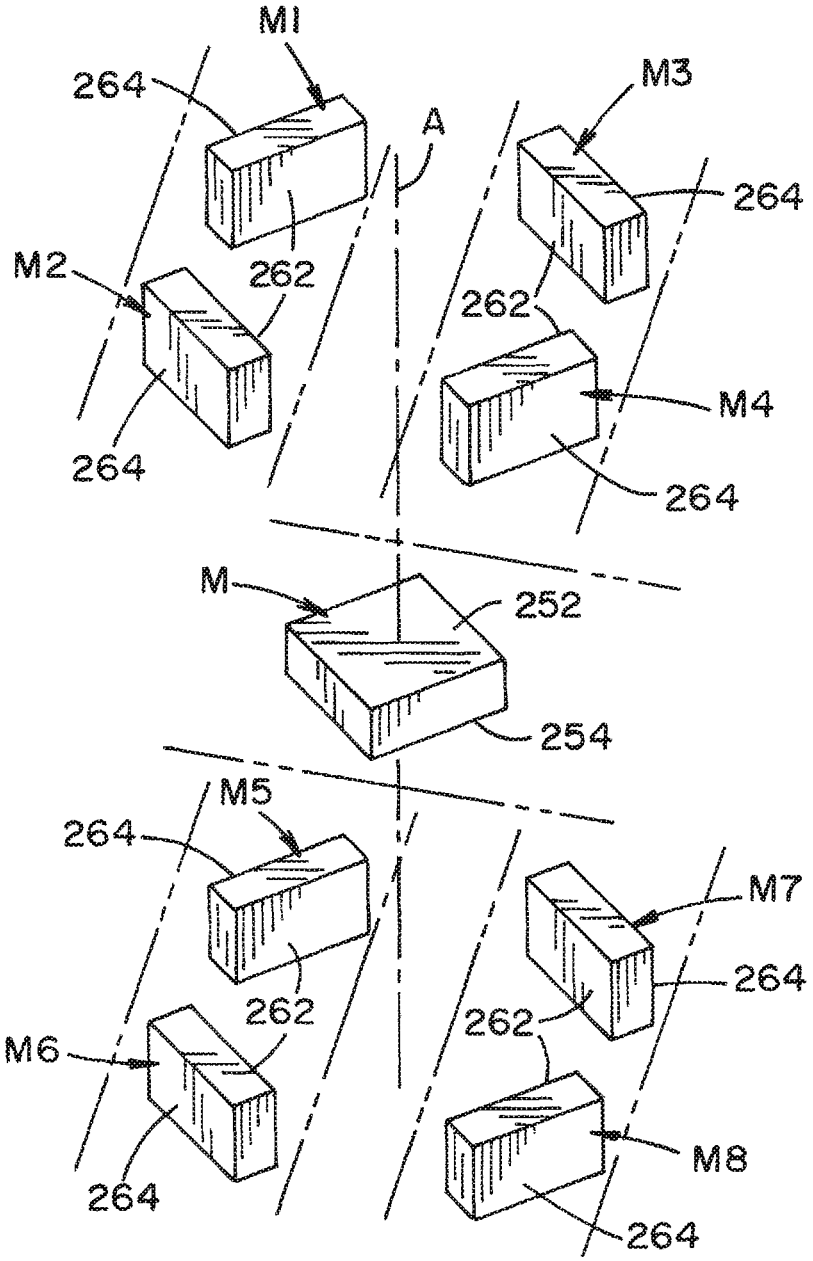
FIG. 7 is an exploded view showing the relative positions of magnets of the floating platen system that are used to maintain a platen of the floating platen system in a substantially stationary position.

In the illustrated embodiment, platen magnet M is generally planar and has a square or rectangular-shape with a top side 252 and a bottom side 254, as best seen in FIG. 7. Top side 252 has a first magnetic polarity, while bottom side 254 has a second magnetic polarity that is opposite the first magnetic polarity. For instance, top side 252 has a north polarity, while bottom side 254 has a south polarity (or vice versa). In one example embodiment, magnet M is a neodymium square magnet (35NE646416) made of neodymium-iron-boron (NdFeB), and having the dimensions: 1.0 inch (width)×1.0 inch (length)×0.250 inch (thickness/height). It will be appreciated that magnets of other shapes, dimensions, and properties are also contemplated. Moreover, platen 210 may include more than one magnet.

Guide assembly 310 is generally comprised of an upper guide member 320, a lower guide member 360, and a support structure that is comprised of mounting blocks 400A, 400B and brackets 410A, 410B. Mounting blocks 400A, 400B are respectively attached to brackets 410A, 410B, such as by welding. The upper and lower guide members 320, 360 are attached to the support structure such that the upper and lower guide members 320, 360 are spaced apart to provide a slot 315 therebetween that is dimensioned to receive platen 210 and allow media 20 to move through slot 315 as it travels along the processing path, as best seen in FIGS. 2 and 3. The support structure is fixed to housing 14.

In the illustrated embodiment, upper guide member 320 is comprised of a first plate 330 and a second plate 340, wherein first and second plates 330 and 340 are spaced apart to provide an opening therebetween. Likewise, lower guide member 360 is comprised of a first plate 370 and a second plate 380, wherein first and second plates 370, 380 are spaced apart to provide an opening therebetween. Opposite ends of plates 330, 340, 370, and 380 are respectively fixed to mounting blocks 400A, 400B by fasteners 312. Fasteners 312 extend through respective mounting holes 336, 346, 376 and 386 of plates 330, 340, 370 and 380. It will be appreciated that in an alternative embodiment, a single plate may be substituted for first and second plates 330, 340, and a single plate may be substituted for first and second plates 370, 380, thereby eliminating the openings between the plates.

First plate 330 of upper guide member 320 includes recesses 332 that are dimensioned to receive magnets M1 and M2; second plate 340 of upper guide member 320 includes recesses 342 that are dimensioned to receive magnets M3 and M4; first plate 370 of lower guide member 360 includes recesses 372 dimensioned to receive magnets M5 and M6; and second plate 380 of lower guide member 360 includes recesses 382 dimensioned to receive magnets M7 and M8.

In the illustrated embodiment, magnets M1-M8 are generally planar and have a square or rectangular-shape with a front side 262 and a rear side 264, as best seen in FIG. 7. In one example embodiment, magnets M1-M8 are neodymium rectangle magnets (35NE602814) made of neodymium-iron-boron (NdFeB), and having the dimensions: 0.4350 inch (width)×0.9450 inch (length)×0.2150 inch (thickness/height). It will be appreciated that magnets of other shapes, dimensions, and properties are also contemplated. It is further contemplated that upper and lower guide members 320, 360 may have a different number of magnets, as well as a different arrangement of magnets, than as shown in the illustrated embodiment.

In the illustrated embodiment of the present invention, magnets M1 and M4 are oriented substantially parallel to each other such that their respective front sides 262 face each other, and magnets M2 and M3 are oriented substantially parallel to each other such that their respective front sides 262 face each other. Front sides 262 of magnets M1-M4 have the same magnetic polarity. Likewise, magnets M5 and M8 are oriented substantially parallel to each other such that their respective front sides 262 face each other, and magnets M6 and M7 are oriented substantially parallel to each other such that their respective front sides 262 face each other. Front sides 262 of magnets M5-M8 have the same polarity. However, the magnetic polarity of front sides 262 of magnets M5-M8 is opposite the magnetic polarity of front sides 262 of magnets M1-M4. Therefore, if front sides 262 of magnets M1-M4 have north polarity, then front sides 262 of magnets M5-M8 have south polarity.

As best seen in FIGS. 2 and 4, magnets M1-M4 of upper guide member 320 are oriented relative to each other such that respective front sides 262 define an inner region therebetween. Likewise, magnets M5-M8 of lower guide member 360 are oriented relative to each other such that respective front sides 262 define an inner region therebetween.

It should be appreciated that while an illustrated embodiment of the present invention relies on the use of magnet repelling forces, it also contemplated that the floating platen system of the present invention may also use magnetic attractive forces in substitution for all or some of the magnetic repelling forces. The attractive forces may be attractive forces between multiple magnets and/or between magnets and a metal attracted to magnets.

Figure 8:
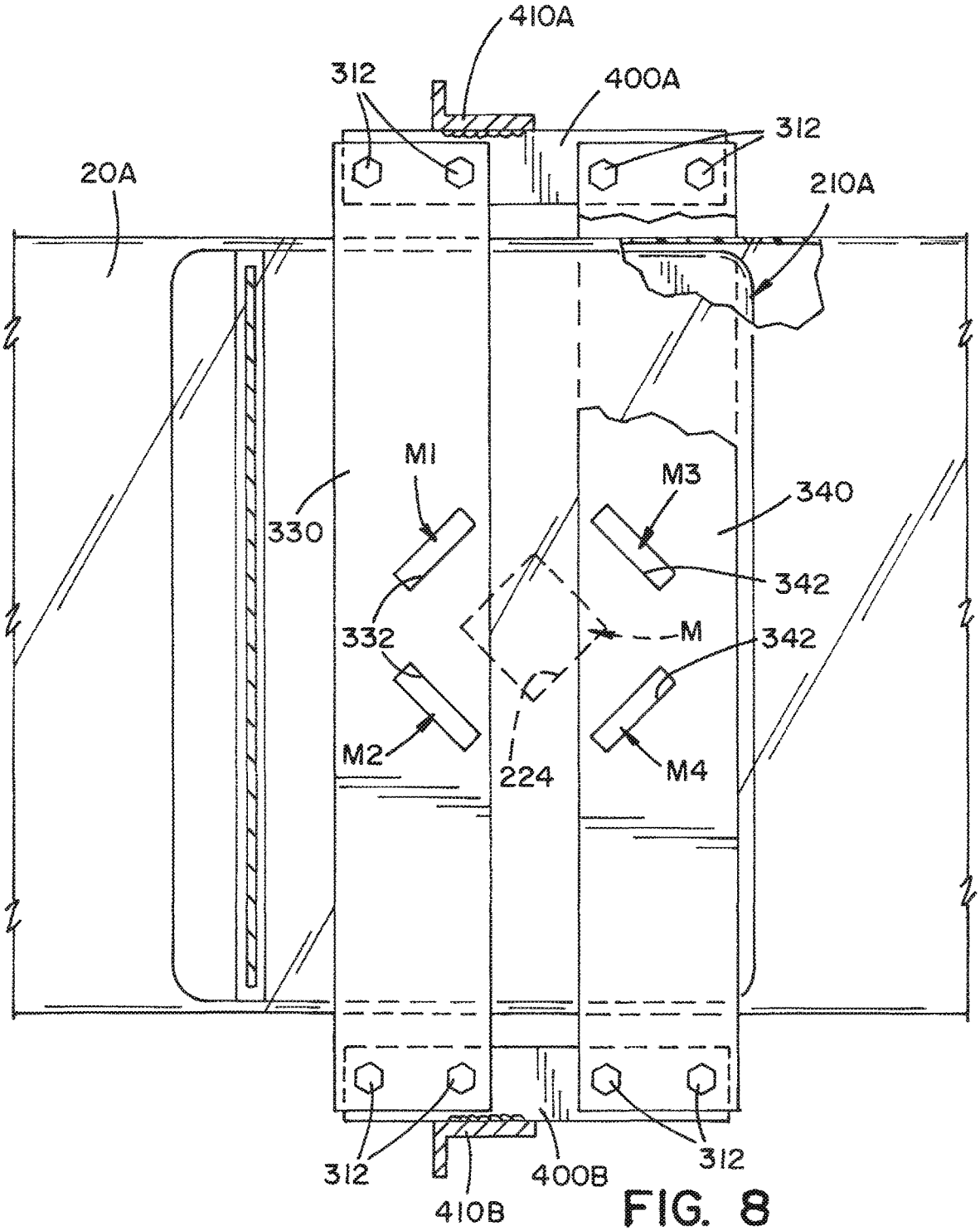
FIG. 8 is a top view of a floating platen system according to an alternative embodiment of the present invention, as adapted for use with media having a larger width.

With reference to FIG. 8, there is shown an alternative embodiment of the present invention with a platen 210A having a larger width than platen 210. Accordingly, platen 210A is adapted to for use with a media 20A having a larger width.

Figure 5:
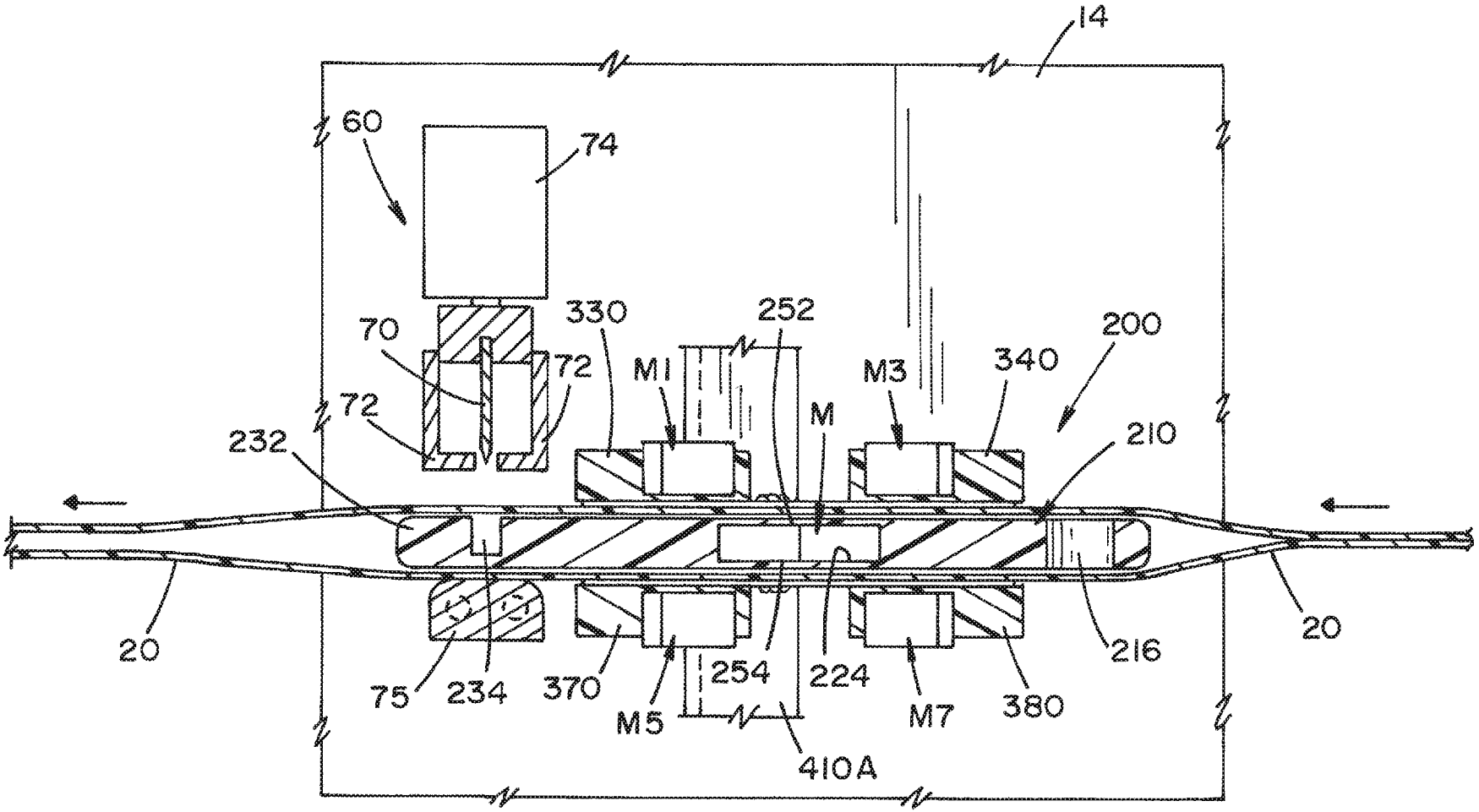
FIG. 5 is a partially broken cross-sectional view of the floating platen system, taken along lines 5-5 of FIG. 2, wherein a blade of a slit forming unit is shown in a retracted position.

Operation of packaging system 10 and floating platen system 200 will now be described in detail. First, platen 210 is inserted into the tube formed by the upper and lower layers of media 20, as best seen in FIG. 4. Next, platen 210 (located inside media 20) is fed through slot 315 and located therein such that groove 234 of rear body portion 232 is aligned with blade 70 of slit forming unit 60, as shown in FIG. 5. To this end, magnets M and M1-M8 facilitate the alignment of platen 210 with respect to blade 70, and also maintaining platen 210 substantially stationary as media 20 flows around platen 210, as it advances through the processing path.

Figure 6:
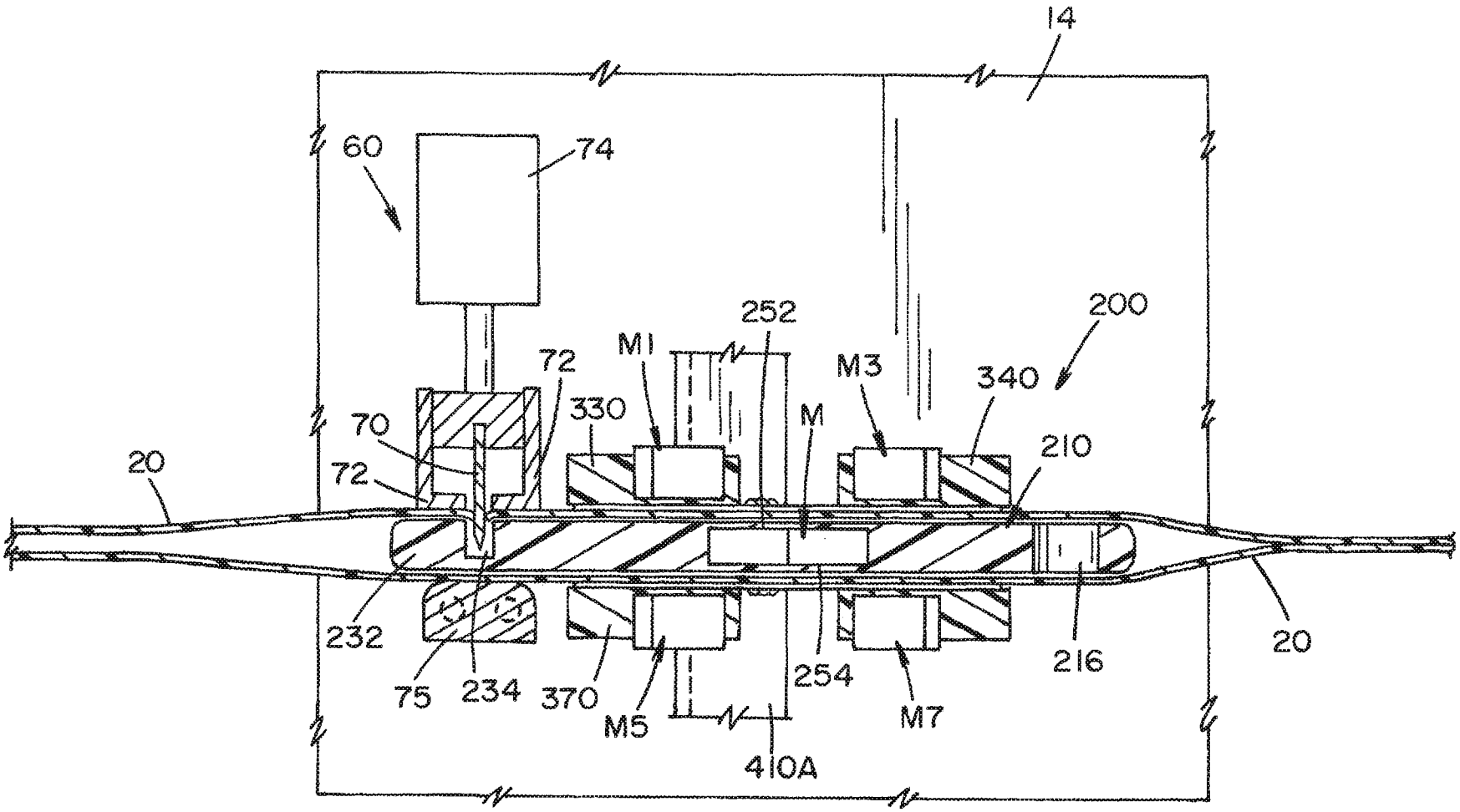
FIG. 6 is a view of the floating platen system of FIG. 5, wherein the blade of the slit forming unit is shown in an extended cutting position.

In accordance with one embodiment of the present invention, platen 210 is oriented within slot 315 such that top side 252 of platen magnet M faces toward magnets M1-M4 of upper guide member 320, and bottom side 254 of platen magnet M faces toward magnets M5-M8 of lower guide member 360. Furthermore, top side 252 of platen magnet M has the same magnetic polarity (e.g., north) as front side 262 of magnets M1-M4 of upper guide member 320, and bottom side 254 of platen magnet M has the same polarity (e.g., south) as front side 262 of magnets M5-M8 of lower guide member 360. By orienting platen 210 within slot 315 such that top and bottom sides 252, 254 of platen magnet M are respectively repelled by front sides 262 of magnets M1-M4 (upper guide member 320) and by front sides 262 of magnets M5-M8 (lower guide member 360), platen 210 is maintained in a substantially stationary position within slot 315 as media 20 moves through the processing path. Furthermore, the repelling forces between magnet M and magnets M1-M4 and magnets M5-M8 suspend platen 210 between the lower surface of upper guide member 320 and the upper surface of lower guide member 360, such that respective gaps are provided therebetween to allow the upper and lower layers of media 20 to flow around platen 210, as best seen in FIGS. 3, 5 and 6.

Returning now to FIG. 5, platen 210 is shown in a substantially stationary position that is maintained by the repelling forces between top side 252 of platen magnet M and magnets M1-M4, and the repelling forces between bottom side 254 of platen magnet M and magnets M5-M8. Groove 234 of platen 210 is maintained in alignment with blade 70 of slit forming unit 60, which forms a slit in the upper layer of media 20 (FIG. 6).

As best seen in FIG. 7, magnets M1-M4 of upper guide member 320 are located in an upper plane located above slot 315, while magnets M5-M8 of lower guide member 360 are located in a lower plane located below slot 315. Platen 210 is positioned within slot 315 such that magnet M is located between magnets M1-M4 of upper guide member 320 and magnets M5-M8 of lower guide member 360, as best seen in FIGS. 5 and 6. In this location within slot 315, the balance of repelling forces between magnets M1-M4 and M, and between magnets M5-M8 and M will maintain platen 210 in a substantially stationary position between upper and lower guide members 320, 360. In the illustrated embodiment, the magnetic repelling forces between magnets M and M1-M8 cause magnet M to be located relative to magnets M1-M4 and magnets M5-M8 such that platen magnet M is generally centered along an axis A that extends through the center of the inner region defined by front sides 262 of magnets M1-M4 and the center of the inner region defined by front sides 262 of magnets M5-M8.

The opening between first and second plates 330, 340 of upper guide member 320 facilitates visually locating platen magnet M in a region of slot 315 between magnets M1-M4 of upper guide member 320 and magnets M5-M8 of lower guide member 360.

Referring now to FIG. 1, media 20 is located between rollers 80 and 82. As media 20 is pulled forward by roller 80, platen 210 remains in a substantially fixed position within slot 315 and suspended between the lower surface of upper guide member 320 and the upper surface of lower guide member 360, as described above. Accordingly, the upper and lower layers of media 20 are free to flow around platen 210. In this regard, the lower layer will flow beneath platen 210, while the upper layer will flow over the top of platen 210. A stepper motor (not shown) advances media 20 a predetermined distance past slit forming unit 60 and temporarily stops further advancement. This predetermined distance determines the length size of the bag. Slit forming unit 60 is moved downward to contact blade 70 with the upper layer of media 20 in order to form the top opening of a bag. Blade 70 is received within groove 234 of platen 210 and pressure feet 72 apply tension to media 20 while the upper layer is being cut (FIG. 6). Thereafter, slit forming unit 60 is retracted, and the stepper motor advances media 20. Media 20 is advanced such that the position of the foregoing cut is aligned with blade 136 of sealing/cutting unit 130 (FIG. 1). In this position, telescoping funnel portion 96 of filling unit 90 is lowered into the newly formed bag opening, and air is blown into the bag to open the bag to receive product. Product is then placed into the bag through funnel portions 92 and 96. Next, funnel portion 96 is retracted and pressure bar 141 of sealing/cutting unit 130 is moved into contact with media 20 to simultaneously press it against upper and lower heater bars 132, 134 and blade 136. As a result, a "bottom" seal is provided for the next bag to be filled with product, a "top" seal is provided for the bag which has just been filled with product, and this newly formed bag is separated from the media stock. The "top" and "bottom" seals are oriented transverse to the peripheral side seals. It should be understood that on the very first run through the processing path, the first bag will be discarded, since it will not have a bottom seal prior to filling with product.

Operation of packaging system 10 is controlled by an electronic control unit (not shown), which preferably includes a microprocessor. The control unit may be programmable via a user interface (not shown), which preferably includes a keypad, control panel, or the like. It should be appreciated that the control unit is programmable to operate in coordination and in communication with a product dispensing device for dispensing product to filling unit 90.

The foregoing describes specific embodiments of the present invention. It should be appreciated that these embodiments are described for purposes of illustration only, and that numerous alterations and modifications may be practiced by those skilled in the art without departing from the spirit and scope of the invention. For example, it is contemplated that the floating platen system of the present invention may be used in connection with packaging systems different from the packaging system illustrated herein. It is intended that all such modifications and alterations be included insofar as they come within the scope of the invention as claimed or the equivalents thereof.

Having described the invention, the following is claimed:

1. A packaging system for forming bags from a tube stock continuous film media having an upper layer and a lower layer, said packaging system comprising:

a floating platen system including:

a platen having a first magnet, the first magnet having a first side and a second side, said first side having a first magnetic polarity and said second side having a second magnetic polarity that is opposite to the first magnetic polarity, wherein said platen is dimensioned to be received into the tube stock continuous film media to isolate the upper layer from the lower layer;

a guide assembly having upper and lower guide members that are spaced apart to form a slot therebetween for receiving the platen, wherein the upper guide member includes one or more magnets configured to define a first inner region and the lower guide member includes one or more magnets configured to define a second inner region, wherein said one or more magnets of the upper guide member repelling the first side of the first magnet and said one or more magnets of the lower guide member repelling the second side of the first magnet to locate the first magnet within the slot in a third region located between the first and second inner regions, and wherein magnetic forces between the magnets of the guide assembly and the first magnet of the platen maintain the platen in a substantially stationary position within the slot; and at least one roller for advancing the tube stock continuous film media through a processing path of the packaging system.

2. The packaging system according to claim 1, wherein the at least one magnet of the upper guide member has a first side and a second side, said first side of the at least one magnet of the upper guide member having the first magnetic polarity; and the at least one magnet of the lower guide member has a first side and a second side, said first side of the at least one magnet of the lower guide member having the second magnetic polarity.

3. The packaging system of claim 2, wherein the first side of the at least one magnet of the upper guide member is a front side of the at least one magnet, and the second side of the at least one magnet of the upper guide member is a rear side of the at least one magnet of the upper guide member.

4. The packaging system of claim 2, wherein the first side of the at least one magnet of the lower guide member is a front side of the at least one magnet, and the second side of the at least one magnet of the lower guide member is a rear side of the at least one magnet of the lower guide member.

5. The packaging system according to claim 1, wherein the at least one magnet of the upper guide member is located in a plane above the slot, and the at least one magnet of the lower guide member is located in a plane below the slot.

6. The packaging system according to claim 1, wherein the magnetic forces between the magnets of the guide assembly and the first magnet of the platen suspend the platen between a lower surface of the upper guide member and an upper surface of the lower guide member such that respective gaps are provided therebetween.

7. The packaging system according to claim 1, wherein the platen includes a front body portion, a rear body portion, and a main body portion located between the front and rear body portions, wherein said first magnet is located in the main body portion.

8. The packaging system according to claim 7, wherein the rear body portion includes a groove extending generally perpendicular to a longitudinal axis of the platen, said groove dimensioned to receive a cutting edge of a blade.

9. The floating platenpackaging system according to claim 7, wherein said front body portion has a tapered front face.

10. The packaging system according to claim 1, wherein each of said upper and lower guide members include a plurality of said magnets to define the first and second inner regions.

11. The packaging system according to claim 10, wherein said upper guide member includes:

first and second magnets having respective first sides that face each other; and third and fourth magnets having respective first sides that face each other, wherein the respective first sides of the first, second, third, and fourth magnets have the same magnetic polarity, and said lower guide member includes:

first and second magnets having respective first sides that face each other; and third and fourth magnets having respective first sides that face each other, wherein the respective first sides of the first, second, third, and fourth magnets have the same magnetic polarity.

12. The packaging system of claim 11, wherein the respective first sides of the first and second magnets of the upper guide member are front sides of the first and second magnets of the upper guide member.

13. The packaging system of claim 11, wherein the respective first sides of the first and second magnets of the lower guide member are front sides of the first and second magnets of the lower guide member.

14. The packaging system according to claim 1, wherein the magnets of the guide assembly and the first magnet of the platen are neodymium magnets.

15. The packaging system of claim 1, wherein the first side of the first magnet is a top side of the first magnet and the second side of the first magnet is a bottom side of the first magnet.

16. The packaging system according to claim 1, wherein said upper guide member includes a plurality of said magnets to define the first inner region.

17. The packaging system according to claim 1, wherein said lower guide member includes a plurality of said magnets to define the second inner region.

18. The packaging system according to claim 1, wherein said packaging system further comprises a slit forming unit for forming a slit in the tube stock continuous film media to provide a bag opening.

19. The packaging system according to claim 1, wherein said packaging system further comprises a filling unit for filling a bag formed by the tube stock continuous film media.

20. The packaging system according to claim 1, wherein said packaging system further comprises a sealing/cutting unit for sealing and cutting bags formed by the tube stock continuous film media.

* * * * *